US005263683A

United States Patent [19]

Wong

[11] Patent Number: 5,263,683

[45] Date of Patent: Nov. 23, 1993

[54] SLIDING SLEEVE VALVE

[75] Inventor: Fred S. Wong, Mandeville, La.

[73] Assignee: Grace Energy Corporation, Dallas, Tex.

[21] Appl. No.: 878,734

[22] Filed: May 5, 1992

[51] Int. Cl.[5] ..... F16K 51/00

[52] U.S. Cl. ..... 251/145; 166/332

[58] Field of Search ..... 166/332; 251/145

[56] References Cited

U.S. PATENT DOCUMENTS

| | | | |
|---|---|---|---|
| 3,071,193 | 1/1963 | Raulins | 166/332 |
| 3,151,681 | 10/1964 | Cochran | 166/332 |
| 3,355,142 | 11/1967 | Kammerer, Jr. et al. | 166/332 |

OTHER PUBLICATIONS

"Sliding Side Door", Otis Engineering Catalog, pp. F-1-F-19. Mar. 1970.

*Primary Examiner*—A. Michael Chambers

*Attorney, Agent, or Firm*—Browning, Bushman, Anderson & Brookhart

[57] ABSTRACT

A sliding sleeve valve for downhole use. A tubular main body has a radial flow port there-through and a primary annular seal carried adjacent its inner diameter and spaced longitudinally from the flow port in a first direction. A sleeve is carried co-axially within the main body for selective relative longitudinal movement. The sleeve has a seal section with an outer diameter sized to slidably sealingly engage the primary seal. The sleeve also has a radial aperture through the seal section and a recess in the outer surface of the seal section, surrounding and longer than the radially outer end of the aperture. The sleeve has a closed position, wherein the aperture and recess are longitudinally spaced from the primary seal in the first direction, and an open position, wherein the aperture is longitudinally spaced from the primary seal in a second direction opposite the first. The recess is sized and configured to permit the aperture to pass the primary seal while moving from closed to open position, under given temperature and pressure conditions, without substantial damage to the primary seal.

33 Claims, 2 Drawing Sheets

SLIDING SLEEVE VALVE

BACKGROUND OF THE INVENTION

The present invention pertains to downhole sliding sleeve valves. An example of such a valve is that sold under the trademark "SLIDING SIDE DOOR" type XA by Otis Engineering, Corp. Such a valve typically has a tubular housing or main body which can be made up into a string of well conduit (typically production tubing, but conceivably drill pipe or some other conduit type) as part thereof. The valve may be used to selectively prevent or permit flow between the well annulus and the interior of the conduit string. For example, packers in the conduit string above and/or below the valve can be used to pack off or isolate a given zone of the well. The sleeve valve can be left closed to maintain that isolation, or when it is desired to produce from that zone, the sleeve valve can be opened to permit that. In other exemplary situations, the valve may be opened to permit a fluid to pass from the interior of the tubing string into the annulus.

The fluid in the isolated zone of the well may be under considerable pressure, and there may be a large pressure differential between the annulus in that zone and the interior of the conduit string. It is highly desirable that these pressures be equalized, as by allowing slow bleeding of pressurized fluid from the annulus into the conduit, before full production flow is established, so that there will not be a sudden surge of pressure into the conduit. Such a surge can be dangerous, for any number of reasons well known to those of skill in the art.

To this end, a typical such sliding sleeve valve has one or more flow ports extending radially through the housing wall. A valve element in the form of a sleeve carried co-axially within the housing for selective longitudinal movement has a closed position in which an unbroken (not perforated) portion of its seal section is aligned with the flow port(s) and sealed with respect to the housing at least by a primary seal spaced in a first longitudinal direction from the flow port(s), and typically also by a first auxiliary seal spaced from the flow port(s) in a second direction opposite the first. This sleeve has a relatively small pressure relief aperture through its seal section, but spaced from the aforementioned sealed off portion, more specifically, spaced in the first direction from the primary seal when the sleeve is in the closed position.

The sleeve can be moved longitudinally within the housing to an open position, more specifically a pressure relief position, by moving it in the second direction so that the pressure relief aperture crosses over to the opposite side of the primary seal and thereby becomes communicable with the flow port. This allows fluid to bleed from the annulus slowly through the pressure relief aperture until the pressure in the conduit is approximately equal to that in the annulus, without any sudden surge of pressure into the conduit. Thereafter, the sleeve can be further moved in the second direction to another open position, specifically a full flow position, in which one or more full flow openings in the sleeve, providing substantially greater flow area than the pressure relief aperture, are communicated with the flow port in the housing.

A common problem with such valves is that, when the sleeve is moving from the closed position to the pressure relief position, the large pressure differential between the annulus and the interior of the conduit is acting on the primary seal urging it radially inwardly tightly against the sleeve. Then, when the edges of the pressure relief aperture cross this seal which is being urged inwardly against them, they can literally clip off a substantial bit of the material of the seal, rendering that seal less effective, or even ineffective, for further sealing. This is particularly disadvantageous since, in many operations, it may be necessary to re-close and subsequently reopen the valve after it has been operated at least once before. Each such reopening may clip off another bit of seal material, so that even if the seal is not ruined on the first pass of the sleeve, it will eventually be ruined by subsequent passes.

The problem is further exacerbated where the primary seal, or at least its innermost portion, is elastomeric, e.g. an o-ring. Under pressure, the elastomeric material deforms and extrudes into the clearance between the sleeve and the housing, rendering an even greater volume of seal material vulnerable. The pressure relief aperture then passes the seal so quickly that, even after the leading edge of the aperture partially passes the seal, thus potentially allowing the elastomer to return to its relaxed configuration, there is not enough time for the elastomer to do that before the trailing edge of the aperture clips it.

There have been efforts to address somewhat similar problems in a downhole safety valve. Such a valve has an axially movable and axially seating valve element, such as a flapper or ball, which when closed, seals across the interior of the well conduit. An ancillary sleeve valve opens and closes a bypass around the main valve element. This valve had a similar problem with clipping of a seal ring when an aperture in the sliding sleeve passed thereacross. Efforts have been made to alleviate this by relieving or recessing the outer surface of the sliding sleeve in the vicinity of the aperture and/or by providing backup rings in the same retaining groove with the seal ring to attempt to prevent the seal ring from extruding into the gap between the sliding sleeve and the surrounding member. To the best knowledge of the present inventor, such devices not only continued to clip the seal ring, but in some instances, even clipped the backup rings.

SUMMARY OF THE INVENTION

The present inventor has found that the seal clipping problem can in fact be virtually eliminated by properly recessing the outer surface of the sleeve in the vicinity of the pressure relief aperture. Indeed, this can be done so successfully that not only backup rings for the primary seal, but even a second auxiliary seal normally provided in such valves, can be eliminated.

The recess in the outer surface of the sleeve surrounds, and is longer than, the radially outer end of the pressure relief aperture. The recess is sized to permit the pressure relief aperture to pass the primary seal, while moving from closed position to pressure relief position, under given temperature and pressure conditions, without substantial damage to the primary seal. This is true even if the primary seal is at least partially elastomeric, e.g. an o-ring.

More specifically, the flow area of the recess, viewed transverse to the centerline of the valve as a whole and adjacent the minimum inner diameter of the primary seal, at said given temperature and pressure conditions, exceeds the area of the pressure relief aperture transverse to its own centerline, in a zone which aligns with the primary seal as the recess crosses the primary seal in moving from closed to pressure relief position before the pressure relief aperture crosses the primary seal, and preferably before the aperture reaches the seal.

The recess preferably also has a maximum width which, at least in the aforementioned zone, is greater than that of the radially outer end of the pressure relief aperture.

The length of the recess preferably exceeds that of the groove in which the primary seal is carried by fifty percent (50%). The length of the recess, and the disposition of the pressure relief aperture with respect thereto, are preferably such that, in moving from closed to pressure relief position, the leading edge of the recess passes the seal groove before the pressure relief aperture aligns with the primary seal.

The angles at which the leading and trailing edges of the recess meet the outer surface of the sleeve are preferably less than or equal to 30°.

Although, as mentioned, the present invention is so effective at eliminating primary seal damage that backup rings can be eliminated, in some instances it may be desired to provide one or two such backup rings. If they are provided, they are placed in the same seal groove as the primary seal, but displaced therefrom in the first direction. They are preferably not elastomeric, but are capable of a somewhat greater degree of compression than would be metal backup rings. They are sized to be slightly compressed between, and bear against, the housing and the sleeve, but without interfering with proper movement of the sleeve. Although, as mentioned, such rings may not really be necessary under the given projected downhole temperature and pressure conditions, they may provide a further fall back measure, in the event that the actual downhole conditions differ substantially from those projected, by compressively bearing against the sleeve and helping to prevent the elastomeric primary seal from extruding into the small clearance between the sleeve and the housing. Even without such unexpected downhole conditions, the space taken up by the backup rings longitudinally of the valve introduces a further time factor facilitating the return of the seal elastomer to its relaxed configuration before it is crossed by the trailing edges of the aperture and/or the recess.

Various objects, features and advantages of the invention will be made more apparent by the following detailed description, the drawings, and the claims.

DETAILED DESCRIPTION

Figure 1:
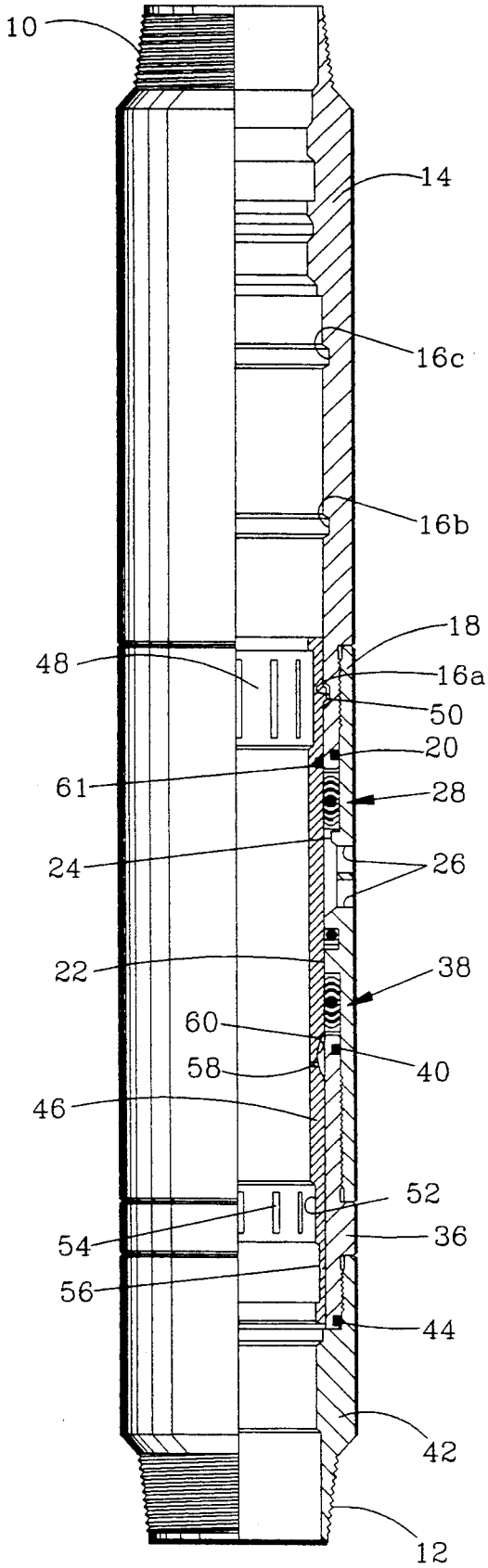
FIG. 1 is a longitudinal quarter-sectional view of a sliding sleeve valve according to the present invention in closed position.

The drawings depict an exemplary downhole sliding sleeve valve for flow control according to the present invention. Except for the recess, to be described below, and certain features of the seals and/or closely associated parts, the valve can be made virtually identical to the prior art flow control sliding valves described above, e.g. the Otis "Sliding Side Door" type XA. Thus, the general structure and operation of the valve will be described rather briefly, to provide background and understanding for the improvements of the present invention.

The valve includes a tubular housing or main body having pin-type connectors 10 and 12 at its ends whereby it may be made up into a string of well conduit to form a part of that string. Most often, the valve will be made up into a string of production tubing, and the following description will proceed on that premise. However, there may be instances in which a similar type of valve might be made up into a string of some other type of well conduit, e.g. drill pipe.

For purposes of this specification, and unless otherwise noted, the terms "longitudinal" and "transverse" will be used with reference to the valve as a whole; "length" of the valve or a part thereof will be with reference to the longitudinal direction of the valve as a whole, "depth" will be with reference to a radial direction with respect to the valve as a whole, and "width" will be with reference to a transverse or circumferential direction with respect to the valve as a whole.

The pin 10 is formed on an uppermost sub 14 of the housing. The lower part of sub 14 is generally the part of largest inner diameter, and has formed therein three annular grooves 16*a*, 16*b*, and 16*c*, for releasably retaining the valve element in three different positions, respectively, as described more fully below. The upper inner surface of sub 14 is formed with a number of other grooves, recesses, shoulders, and the like for cooperating with the wire line tool used to move the valve element, in a manner well known in the art.

The housing further comprises a tubular member 18 threaded onto the lower end of sub 14 and sealed with respect thereto by an o-ring 20 carried in an external groove in sub 14. In general, the inner diameter of member 18 is larger than that of sub 14 except in an upset area 22. Member 18 has a pair of radial flow ports 26 through its wall for potentially allowing fluid to flow between a well annulus in which the valve may be disposed and the interior of the valve, and thus the interior of the tubing string of which it forms a part. The upset area 22 is displaced from ports 26 in a first longitudinal direction (downward as the tool is illustrated). In an opposite or second direction (upward) from the uppermost port 26 there is an annular rim 24 projecting radially inwardly from member 18 so as to oppose the lower end of sub 14 and contain therebetween a first auxiliary seal 28.

Figure 4:
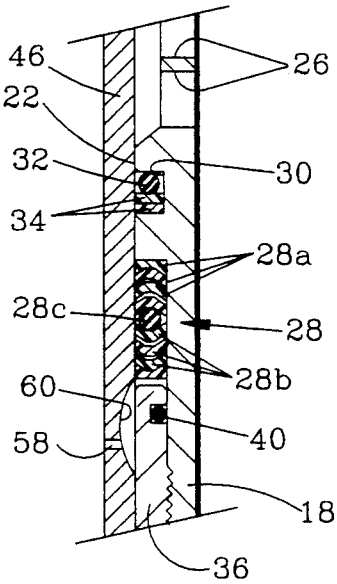
FIG. 4 is an enlarged detailed view of the parts of the valve adjacent the pressure relief aperture in closed position.

As better shown in FIG. 4, seal 28 is actually a stack of seal rings including three upper chevron rings 28*a*, concave downwardly, so as to be self energizing by virtue of pressure from below (i.e. pressure acting in the second direction), three lower chevron rings 28*b* facing in the opposite direction so as to be self-energizing by virtue of pressure acting in the first, i.e. downward, direction, and an o-ring 28*c* disposed between the upper 28*a* and lower 28*b* chevron rings. It is noted that the o-ring 28*c* serves as a spacer, and is not of sufficient diameter to actually seal against the adjacent metal parts.

The upset portion 22 of member 28, which is of the same inner diameter as the main cylindrical surface of the lower part of sub 14, has an annular seal groove 30 formed therein. Seal groove 30 contains an uppermost elastomeric o-ring 32, which serves as the primary seal of the valve, and two polymeric back rings 34 disposed below o-ring 32, all of these rings to be described more fully below.

The lower end of member 18 is threaded into a linking sub 36 whose inner diameter is the same as that of upset 22 and whose upper end opposes the underside of upset 22 to form a space for receipt of a second auxiliary seal 38. Seal 38 is virtually identical to seal 28 in that it comprises stacks of downwardly and upwardly facing chevron rings separated by a spacer o-ring. Sub 36 is sealed with respect to member 18 by an o-ring 40. Threaded onto the lower end of sub 36 is the lowermost sub 42 of the housing, on which is formed pin 12, and which is sealed with respect to sub 36 by an o-ring 44.

The other major large metal part of the valve is the sliding sleeve 46 which is carried co-axially within the housing 14, 18, 36, 42. At its upper end, sleeve 46 includes a radially flexible collet structure 48, on the tines of which are formed a series aligned radially outward projections 50 sized and shaped to fit within any one of the grooves 16*a*, 16*b* or 16*c*.

Otherwise, the outer diameter of sleeve 46 is uniform and sized to slide along the inner diameter of sub 36, upset 22, and the lower part of sub 14. However, as will be appreciated, and as indicated in FIG. 4, to allow such sliding, there must be a slight clearance between sleeve 46 and the last mentioned parts of the housing.

Near its lower end, sleeve 46 has a counterbore 52 through which are formed a series of circumferentially spaced, longitudinally elongated, full flow radial slots 54, for a purpose to be described below. Just below slots 54, sleeve 46 has an internal radial recess 56 which can be engaged by a wire line tool for moving sleeve 46, in a manner well known in the art.

Between collet 48 and full flow slots 54, sleeve 46 has a seal section which is of uniform inner and outer diameter, broken only by at least one pressure relief aperture 58 and a recess 60 in the outer surface of the seal section of the sleeve surrounding and adjoining the radially outer end of aperture 58. Additional apertures and recesses may be provided, circumferentially spaced from the one shown.

An o-ring 61 carried in an external groove in sleeve 46 seals against the inner diameter of sub 14 to prevent fine powder-like debris from jamming the clearance between sleeve 46 and the housing, and thereby preventing proper sliding movement.

FIG. 1 shows the apparatus in closed position. It can be seen that both the aperture 58 and slots 54 are disposed below both the primary seal 32 and the second auxiliary seal 38, the slotted collet 48 is disposed above first auxiliary seal 28, and an unbroken portion of the seal section of the sleeve 46 extends between seals 32 and 28 so that ports 26 are blocked from communication with the interior of the valve and thus the interior of the tubing string.

Figure 2:
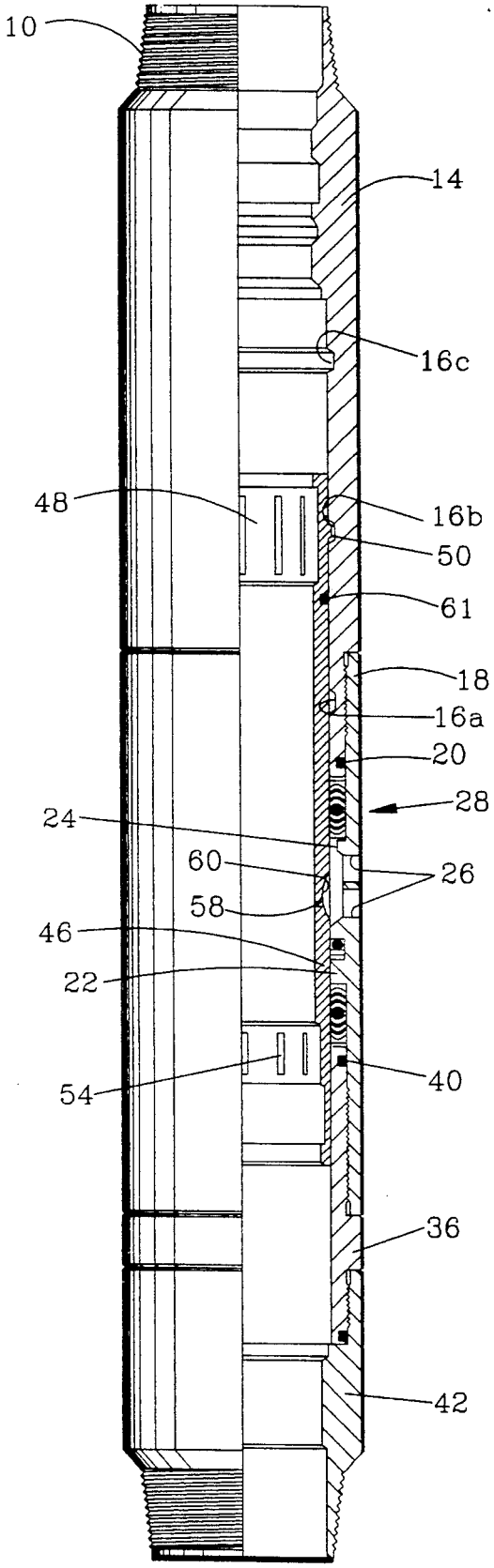
FIG. 2 is a view similar to that of FIG. 1 with the valve in pressure relief position.
Figure 3:
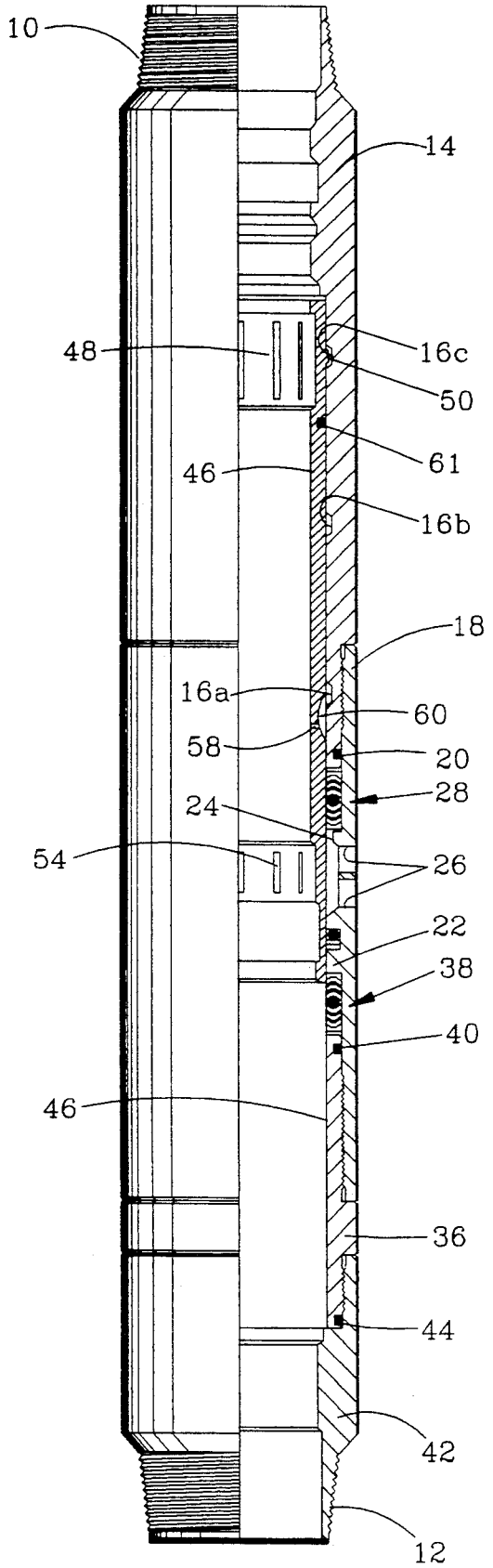
FIG. 3 is a view similar to that of FIG. 1 with the valve in full open position.

When it is desired to open the valve, the sleeve 46 is first moved to a pressure relief position shown in FIG. 2, before being moved to its full open position, shown in FIG. 3.

To begin moving sleeve 46 in that sequence, an operating tool is run down through the tubing string on a wire line and all the way through the lower end of the housing 42. Several conventional, commercially available wire line tools are suitable for this purpose. For example, one such tool, termed a "'B' shifting tool," is available from Tools International, Inc. of Lafayette, La., and another, termed a "selective shifting tool" is available from the same source. After the operating tool has passed through the valve housing, it is then pulled back up via the wire line, and in the well known manner, latches thereon will snap into sleeve 46, e.g. in recess 56. Then, by jarring upwardly on the wire line, the projections 50 on collet tines 48 can be forced out of groove 16*a*, and sleeve 46 drawn upwardly, until projections 50 snap into groove 16*b*, which locates the sleeve 46 in the pressure relief position shown in FIG. 2.

It can be seen that, in the pressure relief position, aperture 58 has moved upwardly so that it is located between seals 32 and 28, and thus in communication with ports 26. However, slots 54 are still sealed off from communication with ports 26 by seals 32 and 38. Thus, the only fluid flow which can occur from the annulus into the tubing string (or vice-versa, depending upon the operation being performed) is a slow bleeding through the small diameter aperture 58. Thus, the pressure within the tubing string can be equalized or nearly equalized with that in the annulus without a sudden surge of pressure up the tubing string.

When such pressure equalization has occurred, further upward jarring on the wire line will force the projections 50 out of groove 16*b* and allow sleeve 46 to be moved further upwardly, until projections 50 snap into groove 16*c*, to locate sleeve 46 in the full flow position shown in FIG. 3. In this position, the slots 54 have moved upwardly past seals 38 and 32, so that they are in communication with ports 26. Thus, fluid can be produced from the annulus and taken up through the string of tubing at a more efficient rate than would have been possible through the aperture 58. It should be noted that full flow openings other than slots 54 could be utilized. For example, with proper positioning of seals 32 and 38, it would be possible simply to use the open lower end of sleeve 46 as the full flow opening.

In moving from the closed position to the pressure relief position, sleeve 46 carries aperture 58 across or past primary seal 32. Ordinarily, because the pressure differential between the annulus and the interior of the tubing tends to extrude and deform o-ring 32 downwardly into the clearance between member 18 and sleeve 46, there would be particular danger that the edges of aperture 58 crossing seal 32, especially the trailing edge, could clip or cut off a substantial portion of the material of seal 32. However, recess 60 allows aperture 58 to cross seal 32 without any substantial damage.

Figure 5:
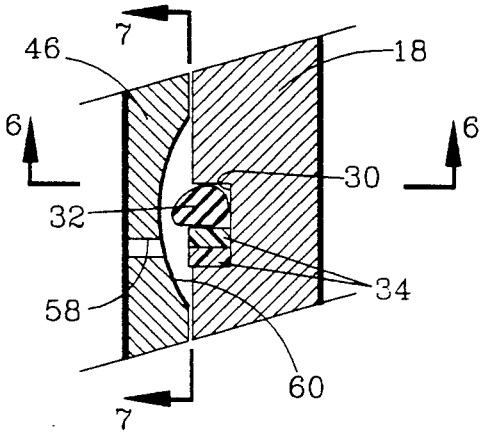
FIG. 5 is a further enlarged view in the same plane as FIG. 4, but showing the recess in the process of passing the primary o-ring seal.

Recess 60 is considerably longer than aperture 58. As best shown in FIG. 5, which illustrates a position between those of FIGS. 1 and 2, aperture 58 is displaced downwardly from the longitudinal center of recess 60, and more specifically, about three-quarters of the way down from the upper or leading edge of recess 60. The longitudinal extent of recess 60 and the disposition of aperture 58 therein are such that the leading edge of the recess passes seal groove 30 before aperture 58 aligns with seal 32. Thus, as sleeve 46 moves upwardly, and recess 60 comes into alignment with o-ring 32, that recess provides pressure relief, space, and (due to its length above aperture 58) time for o-ring 32 to return to its normal rounded configuration before the aperture 58 becomes aligned therewith. Furthermore, because the outer end of aperture 58 is located in the deepest part of recess 60, its edges will not interfere with or substantially contact o-ring 32. The leading and trailing edges of recess 60 are not disposed at such a sharp angle with respect to the outer diameter of sleeve 46, but at angles ≦30°. Furthermore, the trailing edge of recess 60 will pass o-ring 32 only after the latter has had quite a bit of time to return to its normal configuration. Thus, the chance for the trailing edge of the recess 60 to clip the o-ring 32 is minimized.

Figure 6:
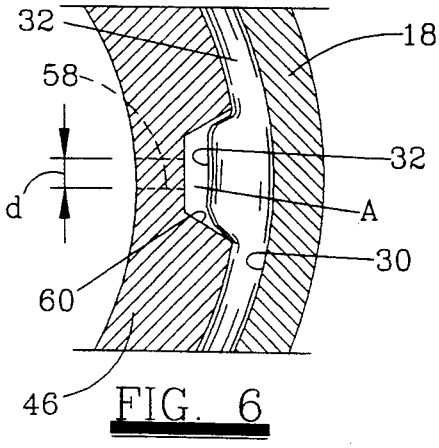
FIG. 6 is an enlarged, detailed, transverse sectional view taken on the line 6—6 of FIG. 5.

Another important factor is the relationship between the transverse cross-sectional flow area provided by the recess 60 and the flow area of aperture 58 transverse to its own centerline. The flow area A provided by the widest and deepest part of recess 60, transverse to the valve as a whole, is shown in FIG. 6. Using well-known engineering principles, and knowing the material of which o-ring 32 is formed, the fluids in which it will be operating, and projected ("given") downhole temperature and pressure, it is possible to calculate the volumetric expansion of o-ring 32 under those conditions, and thus the locus 32' of the inner diameter of that portion of o-ring 32 which will be free to expand inwardly once it is aligned with recess 60. That locus is in its innermost position 32' just before the pressure across the o-ring 32 equalizes, while the o-ring is still deformed by pressure, but has room to expand, and will be referred to herein as the "minimum" inner diameter of the o-ring 32 for those given temperature and pressure conditions.

Even taking into account the space occupied by the bulging of o-ring 32 at 32', it can be seen that the flow area A provided by recess 60 transverse to the centerline of the valve substantially exceeds the area of aperture 58 transverse to its own centerline (i.e. the area of a circle having the diameter d) in a zone of maximum recess width and depth which aligns with o-ring 32 before aperture 58 crosses o-ring 32, and preferably before the aperture 58 even reaches seal 32. Seal 32 is not "bottomed out" in recess 60 when aperture 58 reaches it.

Figure 7:
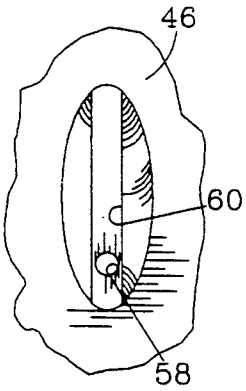
FIG. 7 is a detailed, elevational view taken along the line 7—7 of FIG. 5.

Since the area A is a function of the width and depth of the recess 60, the above condition can be met, without the depth of recess 60 unduly weakening the cross-section of sleeve 46, by making the recess 60 not only longer than the outer end of aperture 58, but also substantially wider, at least along the aforementioned zone (above aperture 58), and preferably also adjacent aperture 58, as indicated in FIGS. 6 and 7.

It is also believed to be advantageous to have the longitudinal extent of the recess 60 exceed that of the seal groove 30 by at least about 50%.

The above expedients so effectively eliminate clipping of seal 32 that it is actually possible to eliminate backup rings 34. However, if such backup rings are desired, it is desirable that they be made of a material which is not elastomeric like seal 32, but is nevertheless somewhat more compressible than metal, so that they can be compressed slightly between the sleeve 46 and member 18. They can thereby resist extrusion of seal ring 32 into the clearance, yet without interfering with proper movement of sleeve 46. To this end, seal rings 34 are preferably sized so that, in a relaxed condition as shown in FIG. 5, they extend radially inwardly only very slightly more than necessary to bridge the aforementioned clearance. They may advantageously be formed of a suitable polymeric material such as a polyetheretherketone, to name just one example. Other examples might include suitable nylons or PTFE's.

An advantage of the use of the backup rings 34 is that they add length to the general seal area, which enhances the time delay factor which allows ring 32 to resume its normal configuration before it is crossed by aperture 58.

So effective is the present invention that, not only could backup rings 34 be eliminated, but the redundant backup seal 38 could also be eliminated. Alternatively, seal 32 could be eliminated, and seal 38 could be the primary seal, and the aperture 58 and its recess 60 would have to be suitably re-arranged and re-configured to properly co-act with seal 38, utilizing the above criteria.

If it is desired to re-close the valve after moving it to either of the open positions of FIGS. 2 or 3, this can be done by jarring downwardly on a suitable wire line tool.

It is interesting to note that the entire valve is reversible, i.e. it could be placed in a tubing string with sub 42 uppermost, and operated by a wire line tool jarring downwardly rather than upwardly, to move the sleeve 46 down from closed to open position. The recess 60 of the present invention will perform equally well if the device is so reversed.

Various modifications of the exemplary embodiment described above may suggest themselves to those of skill in the art. Accordingly, it is intended that the scope of the present invention be limited only by the claims which follow.

What is claimed is:

1. A sliding sleeve valve for controlling flow between a well annulus and a string of well conduit, comprising:

a tubular housing adapted for connection into such string of well conduit as part thereof, and having a radial flow port therethrough and a primary annular seal carried adjacent the inner diameter of the housing and spaced longitudinally from the flow port in a first direction;

a sleeve carried co-axially within the housing for selective relative longitudinal movement, and having a seal section with an outer diameter sized to slidably sealingly engage the primary seal, a radial aperture through the seal section, and a recess extending only part way through the thickness of the sleeve, in the outer surface of the seal section, in communication with the aperture, the sleeve having a closed position wherein the aperture and recess are longitudinally spaced from the primary seal in the first direction, and a pressure relief position wherein the aperture is longitudinally spaced from the primary seal in a second direction opposite the first direction and in communication with the flow port;

the recess being sized, configured, and positioned to permit the aperture to pass the primary seal while moving from the closed position to the pressure relief position, under given temperature and pressure conditions, without substantial damage to the primary seal.

2. The device of claim 1 further comprising a first auxiliary seal carried adjacent the inner diameter of the housing and longitudinally spaced from the flow port in the second direction.

3. The device of claim 2 wherein, when the sleeve is in the pressure relief position, the primary seal and the first auxiliary seal engage an otherwise unbroken portion of the seal section of the sleeve on opposite sides of the aperture.

4. The device of claim 3 wherein the full flow opening means comprises a plurality of full flow radial apertures through the sleeve.

5. The device of claim 4 wherein the full flow apertures are elongated in a longitudinal sense.

6. The device of claim 3 wherein the sleeve has full flow opening means longitudinally spaced from the aperture in the first direction, and the sleeve has a full flow position wherein the full flow opening means is disposed between the primary seal and the first auxiliary seal in communication with the flow port.

7. The device of claim 6 further comprising a second auxiliary seal longitudinally spaced from the primary seal in the first direction.

8. The device of claim 7 wherein each of the auxiliary seals comprises a respective stack of self-energizing seal rings.

9. The device of claim 8 wherein each of the stacks of self-energizing seal rings includes rings facing, respectively, in opposite longitudinal directions so that the seal as a whole may be energized by pressure acting in either longitudinal direction.

10. The device of claim 8 being mechanically operable to move the sleeve longitudinally with respect to the housing.

11. The device of claim 1 wherein the recess has a zone that aligns with the primary seal as the recess crosses the primary seal, in moving from closed to pressure relief position, before the aperture crosses the primary seal.

12. The device of claim 11 wherein the recess surrounds, and is longer than, the aperture.

13. The device of claim 12 wherein the primary seal is at least partially elastomeric.

14. The device of claim 2 wherein the primary seal comprises an o-ring.

15. The device of claim 12 wherein the flow area provided by the recess transverse to the length of the housing, and adjacent the minimum inner diameter of the primary seal, at said given temperature and pressure conditions, exceeds the flow area of the aperture transverse to its centerline, in said zone.

16. The device of claim 15 wherein said zone aligns with the primary seal before the aperture reaches the primary seal.

17. The device of claim 15 wherein the width of the recess in said zone is greater than that of the radially outer end of the aperture.

18. The device of claim 17 wherein the primary seal is carried in a seal groove;

the longitudinal extent of the recess and the disposition of the aperture with respect thereto being such that, in moving from the closed position to the pressure relief position, the leading edge of the recess passes the seal groove before the aperture aligns with the primary seal.

19. The device of claim 18 wherein the primary seal is carried in a seal groove in the housing; and the longitudinal extent of the recess exceeds that of the seal groove by at least about 50%.

20. The device of claim 19 wherein the trailing edge of the recess meets the outer surface of the sleeve at an angle less than or equal to about 30°.

21. The device of claim 15 wherein the primary seal is carried in a seal groove; and the longitudinal extent of the recess and the disposition of the aperture with respect thereto are such that, in moving from the closed position to the pressure relief position, the leading edge of the recess passes the seal groove before the aperture aligns with the primary seal.

22. The device of claim 15 wherein the trailing edge of the recess meets the outer surface of the sleeve at an angle less than or equal to about 30°.

23. The device of claim 15 wherein the primary seal is carried in a seal groove;

further comprising a non-elastomeric, non-metal backup ring in the seal groove longitudinally displaced from the primary seal in the first direction.

24. The device of claim 23 wherein the backup ring has a relaxed inner diameter smaller than that of the longitudinally adjacent portion of the housing.

25. The device of claim 23 comprising two such backup rings adjacent each other.

26. The device of claim 15 being mechanically operable to move the sleeve longitudinally with respect to the housing.

27. A sliding sleeve valve for downhole use comprising:

a tubular main body having a radial flow port therethrough and a primary annular seal carried adjacent the inner diameter of the main body and spaced longitudinally from the flow port in a first direction;

a sleeve carried co-axially within the main body for selective relative longitudinal movement, and having a seal section with an outer diameter sized to slidably sealingly engage the primary seal, a radial aperture through the seal section, and a recess extending only part way through the thickness of the sleeve, in the outer surface of the seal section, in communication with the aperture, the sleeve having a closed position wherein the aperture and recess are longitudinally spaced from the primary seal in the first direction, and an open position wherein the aperture is longitudinally spaced from the primary seal in a second direction opposite the first direction and in communication with the flow port;

wherein the flow area provided by the recess transverse to the length of the main body, and adjacent the minimum inner diameter of the primary seal, at given temperature and pressure conditions, exceeds the flow area of the aperture transverse to its centerline, in a zone which aligns with the primary seal as the recess crosses the primary seal in moving from the closed position to the open position before the aperture crosses the primary seal.

28. The device of claim 27 wherein the recess surrounds, and is longer than, the aperture.

29. The device of claim 28 wherein said zone aligns with the primary seal before the aperture reaches the primary seal.

30. The device of claim 28 wherein the width of the recess in said zone is greater than that of the radially outer end of the aperture.

31. The device of claim 30 wherein the primary seal is carried in a seal groove;

the longitudinal extent of the recess and the disposition of the aperture with respect thereto being such that, in moving from the closed position to the open position, the leading edge of the recess passes the seal groove before the aperture aligns with the primary seal.

32. The device of claim 31 wherein the trailing edge of the recess meets the outer surface of the sleeve at an angle less than or equal to about 30°.

33. The device of claim 27 wherein the trailing edge of the recess meets the outer surface of the sleeve at an angle less than or equal to about 30°.

* * * * *